US008010036B2

(12) United States Patent
Fuchimoto

(10) Patent No.: US 8,010,036 B2
(45) Date of Patent: Aug. 30, 2011

(54) IMAGE FORMING APPARATUS

(75) Inventor: Kazuhiko Fuchimoto, Osaka (JP)

(73) Assignee: Kyocera Mita Corporation (JP)

( * ) Notice: Subject to any disclaimer, the term of this patent is extended or adjusted under 35 U.S.C. 154(b) by 1145 days.

(21) Appl. No.: 11/724,438

(22) Filed: Mar. 15, 2007

(65) Prior Publication Data

US 2007/0217845 A1 Sep. 20, 2007

(30) Foreign Application Priority Data

Mar. 17, 2006 (JP) ..... 2006-074309

(51) Int. Cl.
*G03G 15/00* (2006.01)
*B65H 31/00* (2006.01)

(52) U.S. Cl. ..... 399/405; 399/381; 399/397; 101/474; 271/213; 271/217; 271/218; 271/219; 271/278; 400/691; 400/692; 400/693

(58) Field of Classification Search ..... 399/381, 399/397, 405; 101/474; 271/213, 217, 218, 271/219, 278; 400/691, 692, 693
See application file for complete search history.

(56) References Cited

U.S. PATENT DOCUMENTS 5,497,984 A * 3/1996 Murakami et al. ..... 270/58.02
6,027,114 A * 2/2000 Watanabe et al. ..... 271/265.01
6,792,230 B2 * 9/2004 Saito et al. ..... 399/111
7,263,327 B2 * 8/2007 Nagayama ..... 399/405
2004/0228650 A1 * 11/2004 Saito ..... 399/107

FOREIGN PATENT DOCUMENTS

| | | |
|---|---|---|
| JP | 2000-201257 | 7/2000 |
| JP | 2006-8270 | 1/2006 |
| JP | 2006069693 | 3/2006 |
| JP | 2000327204 | 11/2008 |

* cited by examiner

*Primary Examiner* — Judy Nguyen
*Assistant Examiner* — Andy L Pham
(74) *Attorney, Agent, or Firm* — Gerald E. Hespos; Michael J. Porco

(57) ABSTRACT

An image forming apparatus includes: an apparatus main body that performs image forming processing to a recording sheet; a sheet receiving member provided on a top surface of the apparatus main body and provided with a sheet receiving surface; a sheet discharge port through which a recording sheet bearing thereon a formed image is discharged toward the sheet receiving surface; and a swinging mechanism that allows the sheet receiving member to swing. The swinging mechanism allows the sheet receiving member to swing for the sheet receiving surface to change a posture between a first state where the sheet receiving surface sinks on the sheet discharge port side and a second state where the sheet receiving surface on the sheet discharge port side is closer to horizontal than in the first state.

18 Claims, 9 Drawing Sheets

IMAGE FORMING APPARATUS

BACKGROUND OF THE INVENTION

1. Field of the Invention

The present invention relates to an image forming apparatus, such as a copying machine, a printer, and a facsimile machine using the electrophotographic method, and a complex machine of the foregoing.

2. Description of the Related Art

In an image forming apparatus, such as a copying machine, a printer, and a facsimile machine using the electrophotographic method, and a complex machine of the foregoing, a uniformly charged photoconductor is exposed to light modulated by an image signal and a toner image is formed by developing the resulting electrostatic latent image in the developing device. The toner image is transferred onto a recording sheet and the recording sheet is discharged after the fixing processing is performed.

In order to facilitate the picking up of discharged recording sheets, for example, as is shown in FIG. 1 of JP-A-2006-8270, there is a type having a sheet discharge portion provided on the top surface of the printer main body. This sheet discharge portion is formed by sinking the sheet discharge port side, so that recording sheets are aligned at the rear end in the sheet carrying direction and stacked on the discharge portion in a stable manner. In the case of a copying machine, a facsimile machine, and the complex machine thereof, there is a need to provide an image reading device (scanner), and to meet this need, an image forming apparatus of a type called the body-inside discharge type is provided, in which the scanner is provided on the top surface of the main body, the image forming portion is provided at the lower portion, and the sheet discharge portion is provided in the middle.

For the body-inside discharge type, however, it is necessary to provide a space to enable the body-inside discharge, and the image forming apparatus naturally becomes taller, which makes the use as a desktop unit almost infeasible. Hence, as is disclosed, for example, in JP-A-2000-201257, there has been proposed an image forming apparatus in which the scanner is provided under the image forming portion and, as with the printer or the like, the sheet discharge portion formed by sinking the sheet discharge port side is provided on the top surface of the main body.

However, when the sheet discharge portion is provided on the top surface of the main body of the image forming apparatus by sinking the sheet discharge portion on the sheet discharge port side in this manner, dust readily accumulates on the discharge port side thus sunken. In some cases, dust makes a formed image dirty and printing has to be made again on a new recording sheet. Moreover, when the user tries to remove the accumulated dust, it is not easy to clean the corners on the sunken discharge port side, and the user has to use a tooth pick or the like to remove the dust.

SUMMARY OF THE INVENTION

An object of the invention is to provide an image forming apparatus having a sheet discharge portion on a top surface thereof which can facilitate cleaning of the sheet discharge portion.

An image forming apparatus according to one aspect of the invention that achieves the object includes: an apparatus main body that performs image forming processing to a recording sheet; a sheet receiving member provided on a top surface of the apparatus main body and provided with a sheet receiving surface; a sheet discharge port through which a recording sheet bearing thereon a formed image is discharged toward the sheet receiving surface; and a swinging mechanism that allows the sheet receiving member to swing, wherein the swinging mechanism allows the sheet receiving member to swing for the sheet receiving surface to change a posture between a first state where the sheet receiving surface sinks on the sheet discharge port side and a second state where the sheet receiving surface on the sheet discharge port side is closer to horizontal than in the first state.

These and other objects, features, aspects, and advantages of the present invention will become more apparent from the following detailed description of the preferred embodiments/examples with reference to the accompanying drawings.

DETAILED DESCRIPTION OF THE PREFERRED EMBODIMENTS

Hereinafter, preferred embodiments of the invention will be described in detail by way of example with reference to the drawings. It should be noted, however, that the dimensions, the materials, the shapes, the relative locations, and so forth of the components described in the embodiments below are merely illustrative and are not restrictive to limit the scope of the invention unless specified otherwise.

Figure 1:
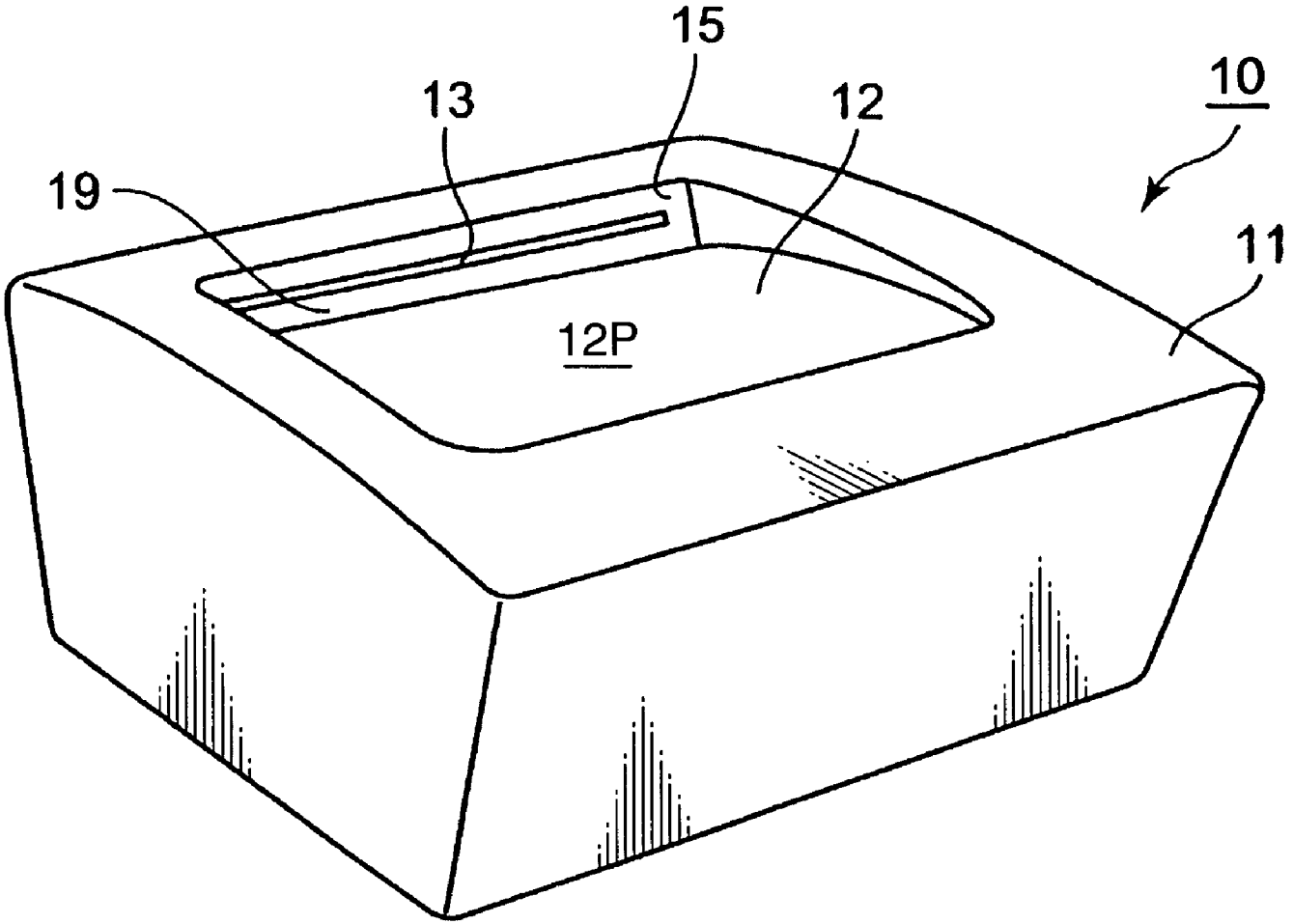
FIG. 1 is an outward perspective view of an image forming apparatus according to an embodiment of the invention.

FIG. 1 is an outward perspective view of one embodiment of an image forming apparatus of the invention. An image forming apparatus 10 has a shape of the apparatus main body of an almost rectangular prism covered with an outer covering 11. A concave portion is formed in the top surface of the apparatus main body, and this concave portion is defined as a sheet discharge portion 19. The bottom surface of the concave portion in the top surface includes a sheet receiving member 12 having a sheet receiving surface 12P on the surface. In addition, one side wall 15 of the concave portion is provided with a sheet discharge port 13 through which a recording sheet bearing thereon a formed image is discharged from the apparatus main body toward the sheet receiving surface 12P.

The sheet receiving surface 12P is of an inclined shape that becomes the lowest on the side wall 15 side in which the sheet discharge port 13 is made and rises with increasing distances from the sheet discharge port 13. This shape is for allowing recording sheets discharged onto the sheet discharge portion 19 to be stacked on the sheet receiving surface 12P in a stable manner by being aligned at the rear end in the sheet carrying (discharging) direction owing to the inclination.

Figure 2:
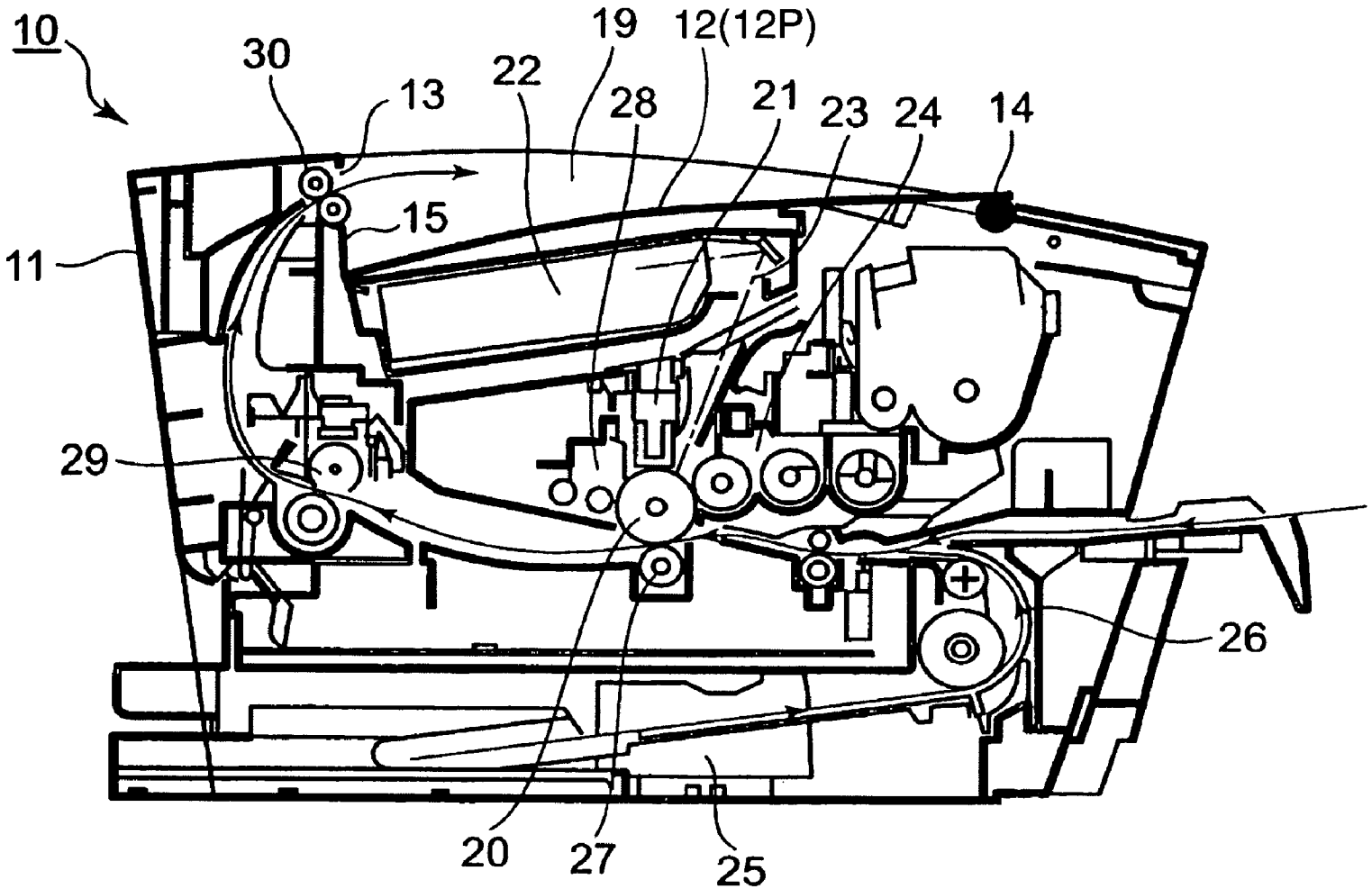
FIG. 2 is a cross section schematically showing the inner configuration of the image forming apparatus.

FIG. 2 is a cross section schematically showing the inner configuration of the image forming apparatus 10. The image forming apparatus 10 includes, as an image forming portion, a photoconductor 20 on which a toner image is formed, a charging device 21, an exposing device 22, a developing device 24, a transferring device 27, and a cleaning device 28 that are disposed on the periphery of the photoconductor 20.

When an image forming instruction is given to the image forming apparatus 10, an unillustrated control device controls the charging device 21 to charge the surface of the photoconductor 20 uniformly. A signal modulated according to image data is sent to the exposing device 22, and light emitted from the exposing device 22 is irradiated toward the photoconductor 20 by passing through an exposing optical path 23. The surface of the photoconductor 20 is exposed to this light and an electrostatic latent image is formed thereon. The electrostatic latent image is developed to a toner image by the developing device 24. The toner image is transferred onto a recording sheet sent from a sheet cassette 25 in the sheet carrying path in the direction indicated by an arrow 26 by the transferring device 27 and is further fixed thereon by a fixing device 29. The recording sheet is then discharged onto the sheet receiving surface 12P of the sheet discharge portion 19 through the sheet discharge port 13 provided with a sheet discharge roller 30.

The sheet receiving member 12 having the sheet receiving surface 12P is allowed to swing in the top-bottom direction about the turning supporting point set on a supporting point 14 provided at the upper right in the drawing. During normal use, the sheet receiving member 12 is set at a position to be in a state (first state as claimed) where the sheet receiving surface 12P sinks on the sheet discharge port 13 side. In this state, recording sheets discharged from the sheet discharge port 13 are stacked on the sheet receiving surface 12P while being aligned at the rear end in the carrying direction.

Meanwhile, when the sheet receiving surface 12P is cleaned, the sheet receiving member 12 is set at a position to be in a state (second state as claimed) where the sheet receiving surface 12P on the sheet discharge port 13 side is closer to horizontal than in the first state. In this embodiment, in the second state, the sheet receiving surface 12P on the sheet discharge port 13 side is elevated to a position at which the sheet receiving member 12 closes the sheet discharge port 13. Hence, when the sheet receiving member 12 is in the second state, the sheet receiving surface 12P is present at the position as high as the top surface of the outer covering 11 of the apparatus main body, which makes the top surface of the apparatus main body substantially flat. A swinging mechanism described below swings the sheet receiving member 12 so that the sheet receiving surface 12P changes the posture between the first state and the second state.

Figure 3:
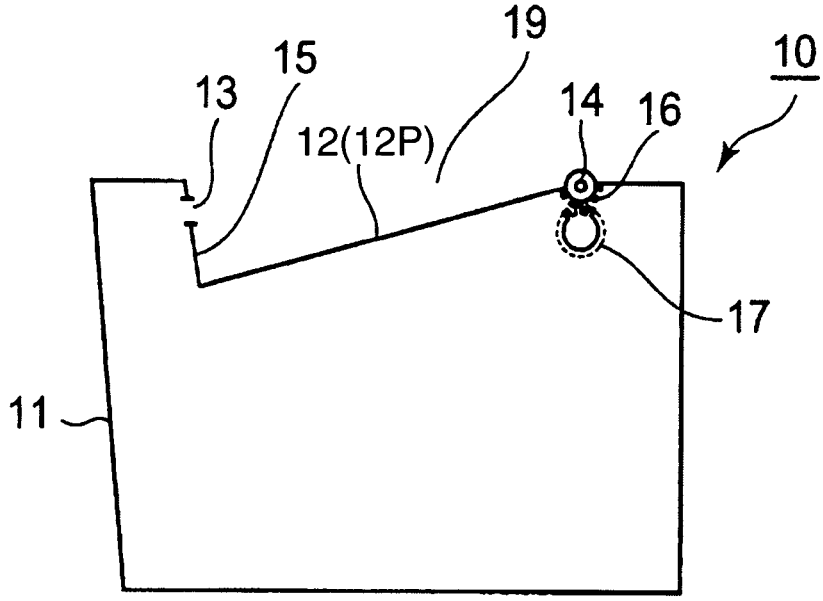
FIG. 3 and FIG. 4 are sectional side views schematically showing one example of a swinging mechanism.
Figure 4:
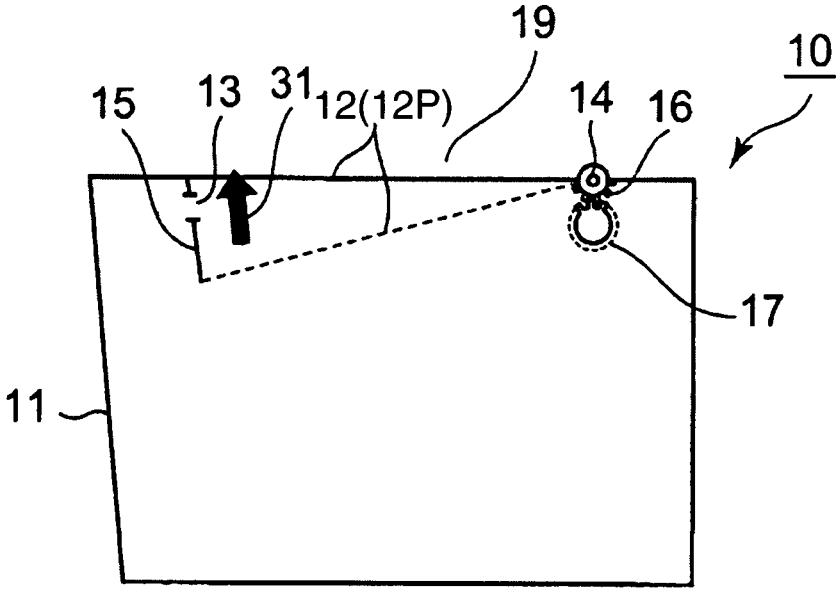

FIG. 3 and FIG. 4 are sectional side views schematically showing one example of the swinging mechanism. The swinging mechanism shown herein by way of example includes a supporting point 14 provided to the edge of the sheet receiving member 12 at the head in the sheet carrying direction, a first gear 16 (swinging gear as claimed) provided integrally with the shaft of the supporting point 14 at one end thereof, and a second gear 17 (second driving force transmission mechanism as claimed) that transmits a driving force from a driving source 51 (FIG. 7) included in the image forming apparatus 10. The first gear 16 and the second gear 17 mesh with each other, and a driving force of the second gear 17 is conferred to the first gear 16, so that the sheet receiving member 12 is swung by this driving force using the supporting point 14 as the turning shaft.

Figure 7:
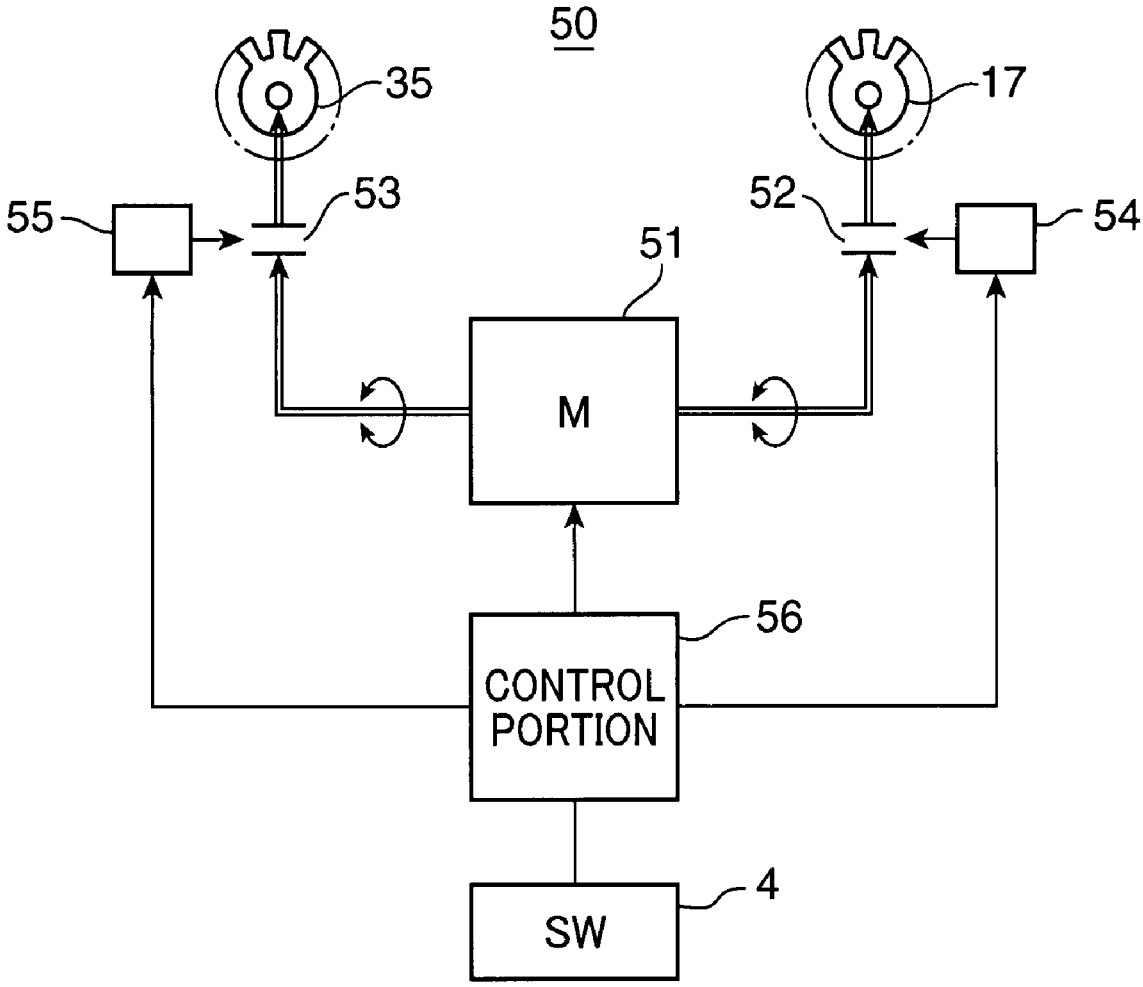
FIG. 7 is a block diagram schematically showing a power transmission system for a second gear and a pinion.

FIG. 3 shows a state where the sheet receiving member 12 is in a normal use state (when the sheet receiving surface 12P is in the first state), and FIG. 4 shows a state where the sheet receiving member 12 has moved up in the direction indicated by an arrow 31 so that the sheet receiving member 12 closes the sheet discharge port 13 to make the top surface of the apparatus main body substantially flat (when the sheet receiving surface 12P is in the second state). The swinging mechanism includes a clutch 52 (FIG. 7). The driving force is transmitted from the second gear 17 to the first gear 16 only when the sheet receiving surface 12P is shifted to the second state from the first state or to the first state from the second state as the clutch 52 is controlled by a control portion 56 (FIG. 7).

Figure 5:
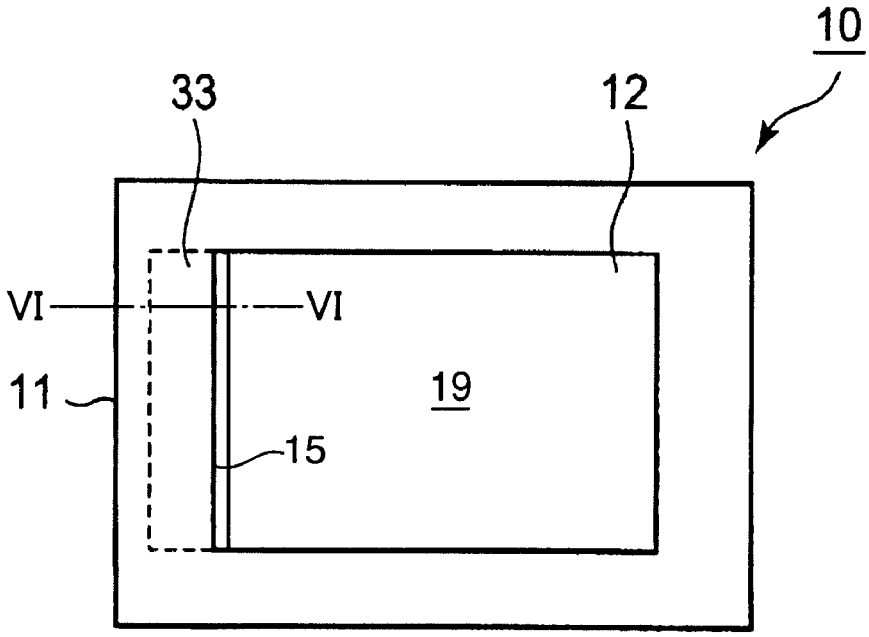
FIG. 5 is a top view when a sheet receiving member is in an elevated state of FIG. 4.
Figure 6:
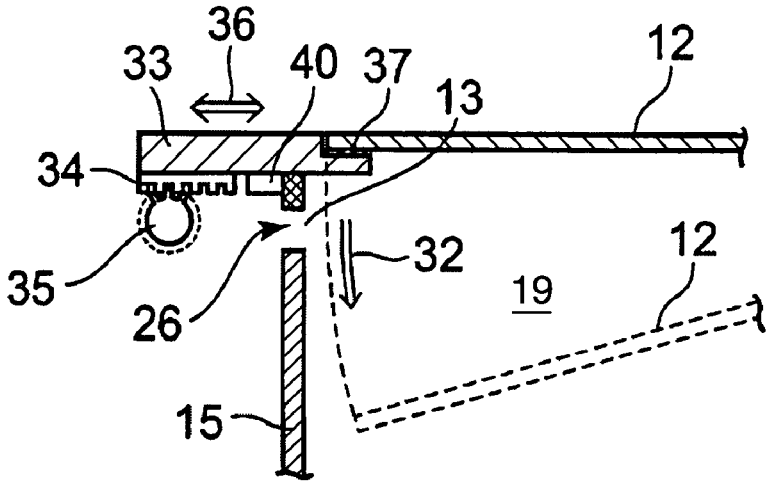
FIG. 6 is a cross section taken on line VI-VI of FIG. 5.

When the sheet receiving member 12 swings about the supporting point 14 as the turning center, a clearance is formed between the end portion of the sheet receiving member 12 and the side wall 15 having therein the sheet discharge port 13. Hence, in this embodiment, as are shown in FIG. 5 and FIG. 6, a covering plate 33 (covering member, not shown in FIG. 2) that covers such a clearance is provided. FIG. 5 is a top view when the sheet receiving member 12 is in the elevated state in FIG. 4, and FIG. 6 is a cross section taken on line VI-VI of FIG. 5.

The covering plate 33 is a movable member that stops the sheet receiving member 12 and covers the clearance between the end portion of the sheet receiving member 12 and the side wall 15 when the sheet receiving member 12 has moved up to the position to close the sheet discharge port 13. In other words, as is indicted by an arrow labeled with reference numeral 36 in FIG. 6, the covering plate 33 is allowed to retract from and project into a space in the sheet discharge portion 19. By providing the covering plate 33 configured in this manner, even when a clearance is formed between the end portion of the sheet receiving member 12 and the side wall 15 due to swings of the sheet receiving member 12, it is possible to close the clearance in preventing dust from going inside the image forming apparatus 10.

The covering plate 33 is a plate member having a width dimension equal to that of the sheet receiving member 12, and disposed at the upper end position of the side wall 15 in such a manner that it is allowed to move by sliding. A step portion 37 to receive the edge portion of the sheet receiving member 12 is provided to the covering plate 33 on the side opposing the sheet receiving member 12. By being supported on the step portion 37 from underneath, the sheet receiving member 12 in an elevated state is stopped so as not to fall off.

The step portion 37 may be omitted, and alternatively, the covering plate 33 may be formed as a flat plate to receive the edge portion of the sheet receiving member 12 or the edge portion of the sheet receiving member 12 may be stopped by being pinched. To allow the covering plate 33 to move, grooves (not shown) that allow the covering plate 33 pinched therebetween to slide are provided in the both ends of the apparatus main body in a direction orthogonal to the moving direction of the covering plate 33.

The covering plate 33 is moved by sliding by a moving mechanism (first driving force transmission mechanism as claimed) including a rack 34 and a pinion 35 meshed with the rack 34. The pinion 35 is driven by the driving source 51 (FIG. 7) included in the image forming apparatus 10.

FIG. 7 is a block diagram schematically showing a power transmission system 50 for the second gear 17 and the pinion 35. The power transmission system 50 includes the driving source 51, the first clutch 52, a second clutch 53, a first coupling driving portion 54, a second coupling driving portion 55, the control portion 56, and a switch 4.

The driving source 51 is a power generating device, such as a motor, provided to confer a driving force to the respective portions of the image forming apparatus 10. The first clutch 52 is a clutch that performs transmission of power from the driving source 51 or cancels the transmission of power for the second gear 17 to swing the sheet receiving member 12. The second clutch 53 is a clutch that performs transmission of power from the driving source 51 or cancels the transmission of power for the pinion 35 that allows the covering plate 33 to move by sliding. The first coupling driving portion 54 and the second coupling driving portion 55 perform coupling and decoupling operations for the first clutch 52 and the second clutch 53, respectively.

The control portion 56 controls the driving of the driving portion 51 and gives a control signal for clutch coupling or decoupling to the first coupling driving portion 54 and the second coupling driving portion 55. The switch 4 is a power supply switch of the image forming apparatus 10.

An example of operations of the power transmission system 50 shown in FIG. 7 will now be described. When the user switches ON the switch 4 and the image forming apparatus 10 is activated, the control portion 56 starts to drive the driving source 51 so that a control signal for "coupling the clutch" is given to the second coupling driving portion 55. The pinion 35 is thus driven, and the covering plate 33 moves by sliding to the left indicated by the arrow 36 in the drawing from the state shown in FIG. 6 via the rack 34, and retracts from the space in the sheet discharge portion 19. As a consequence, the sheet receiving member 12 is released from the stopped state by the step portion 37 of the covering plate 33, which allows the sheet receiving member 12 to move down as indicated by the arrow 32.

Subsequently, the control portion 56 gives a control signal for "decoupling the clutch" to the second coupling driving portion 55 while giving a control signal for "coupling the clutch" to the first coupling driving portion 54. Accordingly, the driving of the pinion 35 is cancelled while the second gear 17 is driven in a direction to let the sheet receiving member 12 move down. Consequently, the sheet receiving member 12 moves down as is shown in FIG. 3 and is brought in a state where the sheet receiving surface 12P is able to receive recording sheets discharged from the sheet discharge port 13. When the sheet receiving member 12 has moved down to the specific position, the control portion 56 gives a control signal for "decoupling the clutch" to the first coupling portion 54 to stop the transmission of a driving force to the second gear 17. The operation of the image forming apparatus 10 is continued in this state.

When an OFF instruction is given from the switch 4, the control portion 56 gives a control signal for "coupling the clutch" to the first coupling portion 54 for the second gear 17 to be driven in a direction to let the sheet receiving member 12 move up before the power supply of the image forming apparatus 10 is shut down. As is indicated by the arrow 31 in FIG. 4, when the sheet receiving member 12 has moved up to a specific position at which the sheet receiving member 12 hides the sheet discharge port 13, the control portion 56 gives a control signal for "decoupling the clutch" to the first coupling driving portion 54 while giving a control signal for "coupling the clutch" to the second coupling driving portion 55.

The pinion 35 is thus driven and the covering plate 33 is moved by sliding via the rack 34 to be brought in a state where, as is shown in FIG. 6, a part of it projects into the space in the sheet discharge portion 19. The covering plate 33 covers the clearance between the end portion of the sheet receiving member 12 and the side wall 15 having therein the sheet discharge port 13, and prevents the sheet receiving member 12 from falling off by stopping the edge portion of the sheet receiving member 12 with the step portion 37. The control portion 56 then switches OFF the power supply of the image forming apparatus 10 completely.

Because the control as described above is performed, when the image forming apparatus 10 is not in use (when the power supply stays OFF), as are shown in FIGS. 4 through 6, the sheet receiving member 12 closes the sheet discharge port 13 and makes the top surface of the image forming apparatus 10 substantially flat. Hence, even when the sheet receiving surface 12P is brought in a state where it sinks on the sheet discharge port 13 side during use and dust is accumulated therein, the user can readily clean the dust.

Further, because the sheet receiving member 12 that makes the top surface flat is stopped by the covering plate 33 that covers the clearance, it is inhibited from falling off, which makes it possible to place an object on the top surface of image forming apparatus 10 that is made flat. In addition, because the covering plate 33 retracts from the space in the sheet discharge portion 19 while the image forming apparatus 10 is in use (when the power supply stays ON), there will be no problem when recording sheets discharged onto the sheet discharge portion 19 are picked up.

While one example of the image forming apparatus 10 of this embodiment has been described, the invention can be modified in various manners. For example, the embodiment has described an example where the moving mechanism of the covering plate 33 and the swinging mechanism of the sheet receiving member 12 are driven by a driving force from the driving source 51 equipped to the image forming apparatus 10. However, such movements and swings can be achieved by various methods, for example, by manual operations, using a pushing member, such as an elastic member or an actuator, combining a driving force of the driving source 51 and the pushing member or the manual operation, and so forth.

The embodiment above described that the movement of the covering plate 33 and the movement of the sheet receiving member 12 are associated with the ON/OFF instructions of the power supply of the image forming apparatus 10. However, the ON/OFF switching of the image forming apparatus 10 may be associated with the operations themselves of the covering plate 33 and the sheet receiving member 12.

For example, the covering plate 33 may be moved manually, so that the power supply of the image forming apparatus 10 is switched ON upon detection of such a movement. Alternatively, there is a method by which the covering plate 33 is moved and the sheet receiving member 12 is moved down manually, and a switch depressed by the back surface of the sheet receiving member 12 when the sheet receiving surface 12P has moved down to be in the first state is provided or a switch activated depending on the swinging angle of the sheet receiving member 12 is provided to the supporting point 14 of the sheet receiving member 12.

Hereinafter, some modifications will be described with reference to the drawings.

Firstly, regarding the movements of the covering plate 33 between the stopping position to support the sheet receiving member 12 and the non-stopping position to retract from the space in the sheet discharge portion 19 as indicated by the arrow 36 in FIG. 6, such movements are achieved by allowing all the movements to take place automatically, making the movement to either one of the non-stopping position and the stopping position manually and allowing the movement to the other position to take place automatically, or making all the movements manually.

Of these methods, as the method for allowing the covering plate 33 to move completely automatically, besides the method of driving the rack 34 and the pinion 35 by sharing the driving source 51 in the image forming apparatus 10 as described above, for example, there is a method using a retraction and projection mechanism separately provided to the covering plate 33.

Figure 8A:
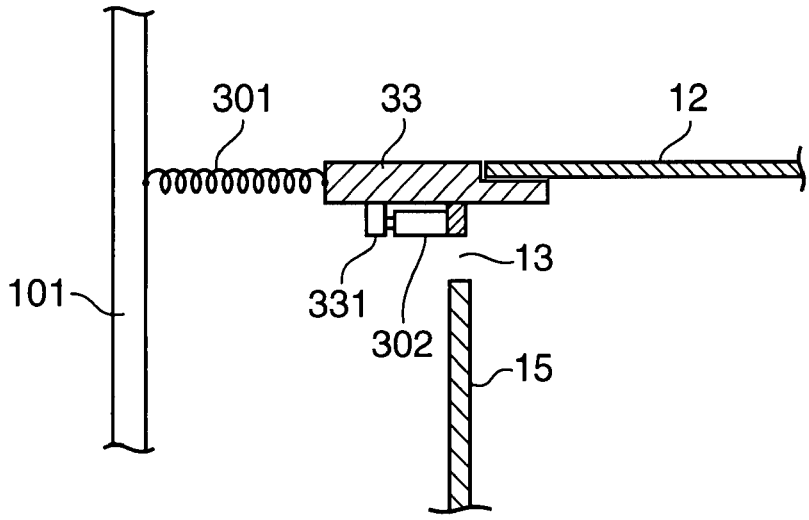
FIGS. 8A and 8B are schematic views showing another embodiment of a moving mechanism of a covering plate.
Figure 8B:
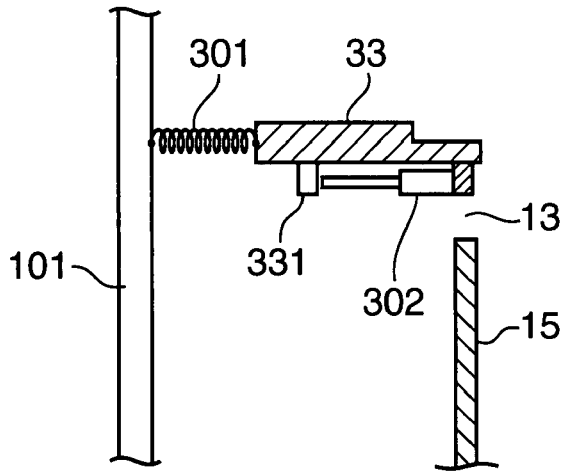

One example of this method is shown in FIGS. 8A and 8B. Herein, a moving mechanism is shown by way of example, which is provided with a spring 301 (first pushing member as claimed) that pushes the covering plate 33 in a direction toward the stopping position of the sheet receiving member 12 and a solenoid actuator 302 (first driving member as claimed) that moves the covering plate 33 in a direction toward the non-stopping position of the sheet receiving member 12 against the pushing force of the spring 301.

The spring 301 is attached to a frame 101 of the apparatus main body at one end and to the rear edge of the covering plate 33 at the other end. The actuator 302 is disposed at the upper end position of the side wall 15, and the driving portion abuts on a receiving surface 331 of the covering plate 33 provided to protrude from the bottom surface. When the actuator 302 is not operating, as is shown in FIG. 8A, the covering plate 33 is pushed by the spring 301 and is thus located at the stopping position. Meanwhile, when the actuator 302 is operating, as is shown in FIG. 8B, the covering plate 33 is pushed by the actuator 302 against the pushing force of the spring 301 so as to retract to the non-stopping position.

As the method for switching ON/OFF the power supply of the image forming apparatus 10 in response to movements of the covering plate 33, there is a method by which, for example, a limit switch or a magnetically-activated power supply switch (first power supply switch as claimed) of the image forming apparatus 10 is provided to the position indicated by reference numeral 40 in FIG. 6. For example, it may be configured in such a manner that the switch 40 comes ON by moving the covering plate 33 manually to the left in the drawing and the switch 40 goes OFF by moving the covering plate 33 to the right in the drawing.

In should be noted, however, that in the case of the configuration where the sheet receiving member 12 is stopped by providing the step portion 37 to the covering plate 33 as is shown in FIG. 6, when the covering plate 33 is moved to the stopping position of the sheet receiving member 12 to switch OFF the power supply, the sheet receiving member 12 interferes with the covering plate 33. Hence, in order to achieve the state shown in FIG. 6, the covering plate 33 has to be moved again to the left in the drawing. Accordingly, for example, the covering plate 33 is moved manually to the position at which the switch 40 goes OFF for the sheet receiving member 12 to move up by the OFF signal, after which the covering plate 33 is moved further to the stopping position of the sheet receiving member 12. Alternatively, it may be configured in such a manner that the switch 40 goes OFF in response to a slight movement of the covering plate 33 in the direction toward the stopping position for the sheet receiving member 12 to move up, after which the covering plate 33 moves automatically to the stopping position of the sheet receiving member 12.

The power supply may be switched OFF by a switch provided separately for switching OFF the power supply. In this case, the sheet receiving member 12 moves up and the covering plate 33 moves to the stopping position automatically using the driving source 51 of the image forming apparatus 10 as in the embodiment described above. The switch 40 and the switch for switching OFF the power supply may be provided in the form of a three-way switch, so that the switch 40 is used always to switch ON the power supply while the other switch is used to switch OFF the power supply.

Regarding swings of the sheet receiving member 12 between the normal position (when the sheet receiving surface 12P is in the first state) and the elevated position (when the sheet receiving surface 12P is in the second state), they can be achieved by various methods, for example, by allowing all the movements to take place automatically, performing movement from the normal position or the elevated position to the other position manually and allowing the movement in the opposite direction to take place automatically, and so forth. Various embodiments of a mechanism for swinging the sheet receiving member 12 between the normal position and the elevated position and the configuration to switch ON/OFF the power supply of the image forming apparatus 10 in response to the swings of the sheet receiving member 12 are shown in FIG. 9 through FIG. 12.

Figure 9:
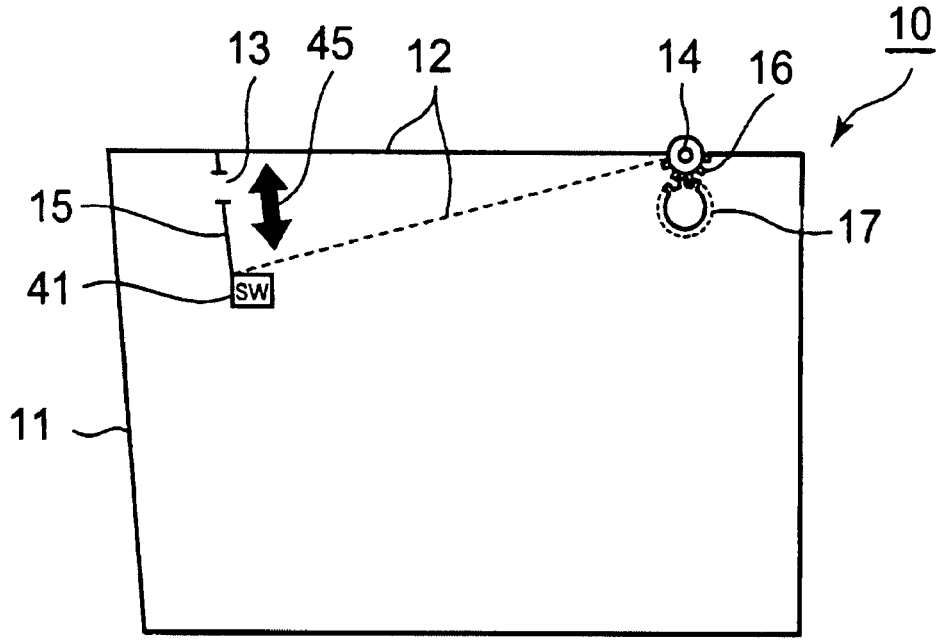
FIGS. 9 through 14 are sectional side views schematically showing other embodiments of the swinging mechanism of the sheet receiving member.
Figure 10:
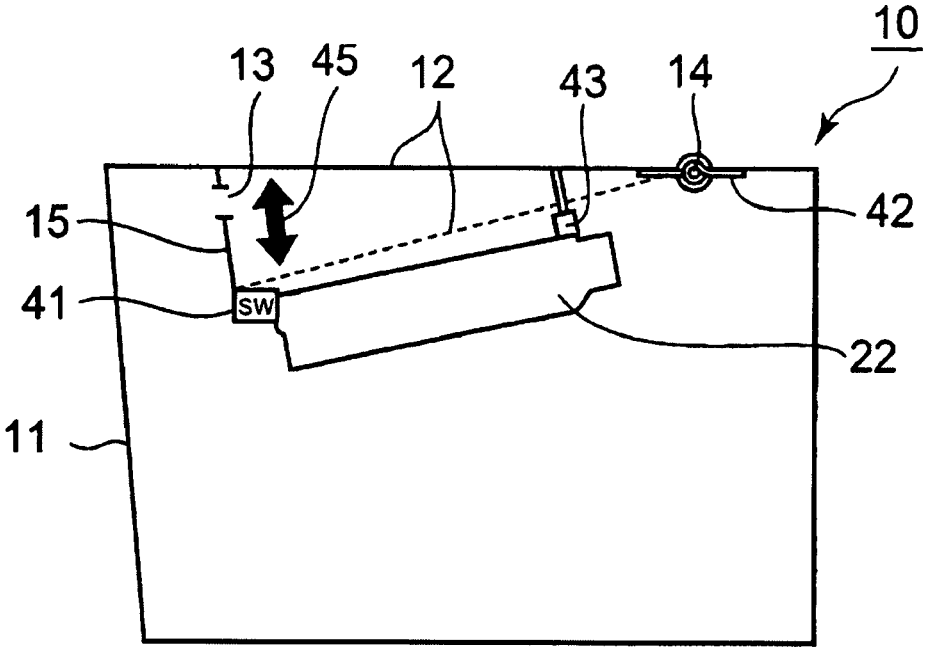
Figure 11:
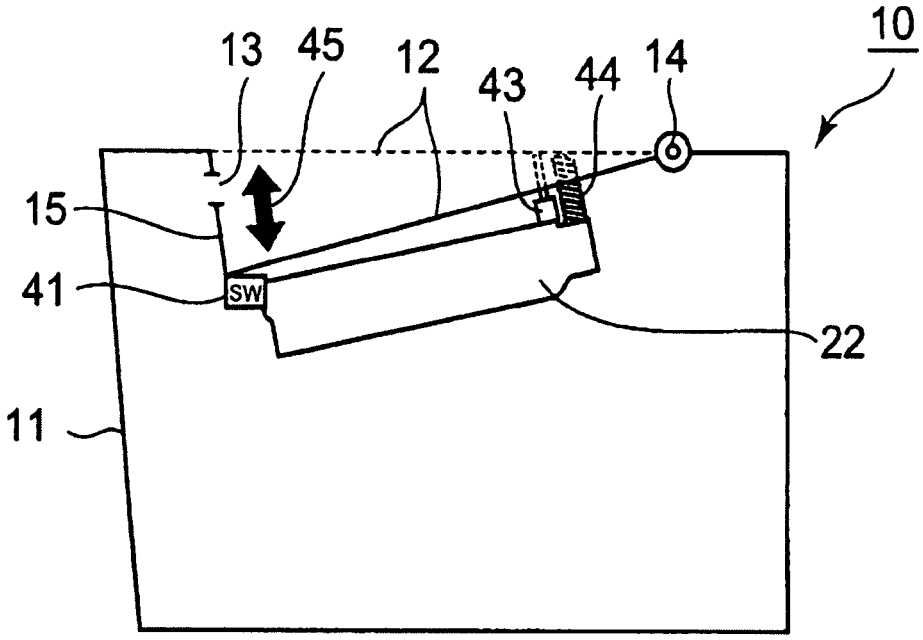
Figure 12:
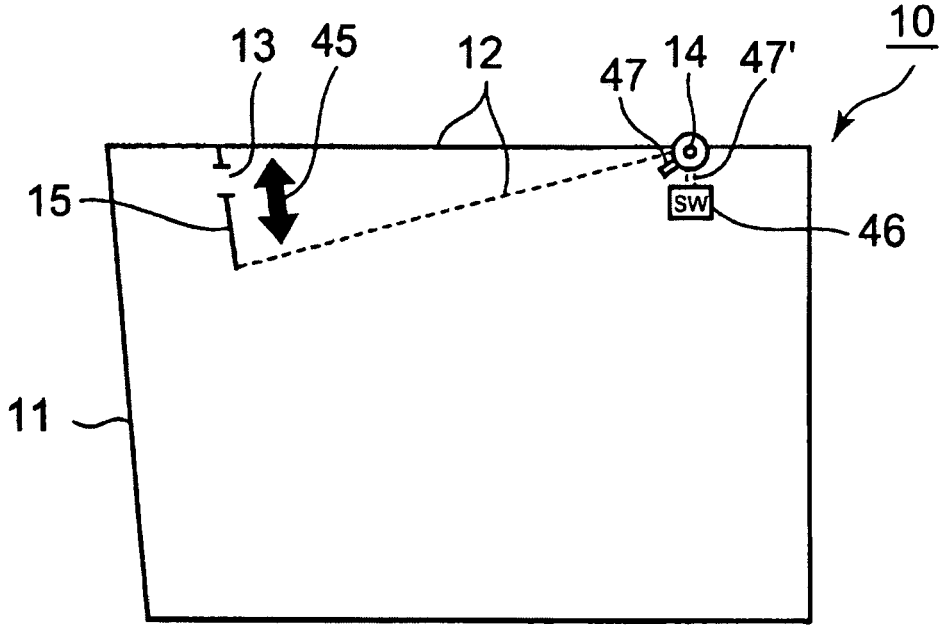

Regarding the configuration to switch ON/OFF the power supply of the image forming apparatus 10, FIG. 9 through FIG. 11 show embodiments in which a switch 41 (second power supply switch as claimed) that comes ON and goes OFF when depressed by the sheet receiving member 12 is provided at the normal position of the sheet receiving member 12 to switch ON/OFF the power supply of the image forming apparatus 10. FIG. 12 shows a case where a switch 46 that comes ON and goes OFF depending on the swinging angle of the sheet receiving member 12 is provided to the supporting point 14 of the sheet receiving member 12.

Regarding the mechanism to swing the sheet receiving member 12 between the normal position and the elevated position, FIG. 9 shows an embodiment in which the sheet receiving member 12 is swung using a driving force from the driving source of the image forming apparatus 10. FIG. 10 shows an embodiment in which a spring 42 is incorporated into the supporting point 14 of the sheet receiving member 12 to push the sheet receiving member 12 in a direction toward the elevated position while the sheet receiving member 12 is moved down to the normal position by an actuator 43. FIG. 11 shows an embodiment in which pushing in the direction toward the elevated position is performed by a coil spring 44. Although the swinging mechanism is omitted from FIG. 12, any one of the swinging mechanisms in FIG. 9 through FIG. 11 is applicable.

In the embodiment shown in FIG. 9, the swinging mechanism of the sheet receiving member 12 is the same as described above with reference to FIG. 3. In order to switch ON/OFF the power supply of the image forming apparatus 10, the switch 41 that comes ON or goes OFF when depressed by the sheet receiving member 12 is provided to the normal position of the sheet receiving member 12. According to this configuration, the switch 41 is activated by moving down the sheet receiving member 12 manually in the direction indicated by an arrow 45 to the position of the switch 41. In this case, because the power supply of the image forming apparatus 10 does not come ON unless the switch 41 is depressed by the sheet receiving member 12, even when the first gear 16 and the second gear 17 mesh with each other, it is possible to move down the sheet receiving member 12 manually to the position of the switch 41.

Hence, in order to switch ON the power supply of the image forming apparatus 10, in a case where the covering plate 33 is provided, the covering plate 33 is moved manually to the non-stopping position and the sheet receiving member 12 is moved down manually to activate the switch 41. In order to switch OFF the power supply of the image forming apparatus 10, the switch 41 is depressed again by the sheet receiving member 12, so that a power supply switching OFF signal is sent from the switch 41 to the control portion 56 (FIG. 7). In this case, the switch 4 in the block diagram of FIG. 7 is replaced by the switch 41.

Thereafter, as has been described, the control portion 56 controls the first coupling driving portion 54 and the second coupling driving portion 55 to respectively drive the second gear 17 and the pinion 35 sequentially, so that the sheet receiving member 12 is moved to the elevated position while the covering plate 33 is moved to the stopping position.

This power supply switching OFF operation may be performed by a switch provided separately for switching OFF the power supply. In this case, as described above, by providing these switches in the form of a three-way switch, the switch 41 is always used to switch ON the power supply while the other switch is used to switch OFF the power supply.

In a case where a large number of recording sheets are stacked on the sheet receiving surface 12P, there is a concern that the switch 41 is depressed by the weight of the recording sheets and a power supply switching OFF instruction may be provided accidentally. This inconvenience can be eliminated by providing an elastic member that pushes the sheet receiving member 12 in the direction toward the elevated position to secure an interval between the sheet receiving member 12 and the switch 41.

In the embodiment shown in FIG. 10, an elastic member including the torsion coil spring 42 (second pushing member as claimed) is incorporated into the supporting point 14 of the sheet receiving member 12 to push the sheet receiving member 12 in the direction toward the elevated position while a solenoid actuator 43 (second driving member as claimed) is used to move down the sheet receiving member 12 to the normal position. The spring 42 may be an elastic member other than a torsion spring coil as long as one end thereof is provided to part of the outer covering 11 or the housing of the image forming apparatus 10 and the other end is provided to the sheet receiving member 12 to push the sheet receiving member 12 in the direction toward the elevated position about the supporting point 14. In addition, the actuator 43 is attached, for example, to the top surface of the exposing device 22 (FIG. 2).

Operations of the mechanism shown in FIG. 10 are the same in the case of FIG. 9 except that the spring 42 and the actuator 43 are used as the driving source. Initially, the covering plate 33 is moved manually to the non-stopping position, and the sheet receiving member 12 is moved down manually to activate the switch 41 (third power switch as claimed). The actuator 43 then forcedly keeps the sheet receiving member 12 at the normal position against the pushing force of the spring 42 in the direction toward the elevated position.

In order to switch OFF the power supply of the image forming apparatus 10, the switch 41 is depressed again by the sheet receiving member 12. A power supply switching OFF signal is then sent from the switch 41 to a control portion similar to that in FIG. 7, and the supply of an electric current to the actuator 43 is cut. The sheet receiving member 12 is thus moved up by the pushing force of the spring 42. Subsequently, the covering plate 33 is moved to the stopping position of the sheet receiving member 12, either manually or automatically.

This power supply switching OFF operation may be performed by a switch provided separately for switching OFF the power supply. In this case, as described above, by providing these switches in the form of a three-way switch, the switch 41 is always used to switch ON the power supply while the other switch is used to switch OFF the power supply.

In the embodiment shown in FIG. 11, the coil spring 44 to push the sheet receiving member 12 in a direction toward the elevated position is used. This embodiment is the same as the embodiment shown in FIG. 10 in that the actuator 43 is used to move down the sheet receiving member 12 to the normal position.

The embodiment of FIG. 12 shows an example where a switch 46 (fourth power supply switch as claimed) that comes ON and goes OFF depending on the swinging angle of the sheet receiving member 12 is provided to the supporting point 14 of the sheet receiving member 12. A mechanism to move the sheet receiving member 12 to the normal position from the elevated position and conversely from the normal position to the elevated position can be any of the examples described above: the method of FIG. 9 using a driving force from the driving source of the image forming apparatus 10; the method of FIG. 10 using the spring 42 incorporated into the supporting point 14 of the sheet receiving member 12 as well as the actuator 43; and the method of FIG. 11 using the coil spring 44 and the actuator 43 for the sheet receiving member 12.

The switch 46 can be of any type as long as it is a switch that comes ON and goes OFF when the sheet receiving member 12 has swung by or greater than a specific angle from the elevated position. For example, a limit switch or a magnetically-activated switch can be used. For example, in the case of a magnetically-activated switch, a protrusion 47 including a magnetic body is provided to the supporting point 14, so that when the sheet receiving member 12 is swung manually from a first position indicated by a solid line to a second position indicated by a broken line, the protrusion 47 is swung as well to a position indicated by a reference numeral 47' to switch ON the switch 46.

In order to prevent the protrusion 47 from moving to the OFF position by a weight of the discharged recording sheets, it is preferable to secure an interval between the protrusion 47 and the switch 46 using an elastic member. When the power supply is switched OFF, the power supply is switched OFF by moving down the sheet receiving member 12 again. The operations after this switching OFF operation are the same as those described with reference to FIG. 9 and FIG. 10, and descriptions thereof are omitted herein.

By bringing the operations of the covering plate 33 and the sheet receiving member 12 into association with the ON/OFF switching of the power supply of the image forming apparatus 10 in this manner, the turning-on of the power to the image forming apparatus is not allowed unless the covering plate 33 and the sheet receiving member 12 are moved. This configuration prevents an event that a recording sheet is discharged while the sheet discharge port 13 is closed. Further, because a portion above the sheet discharge port 13 that lies in the way when picking up the recording sheets is eliminated or becomes quite small as the covering plate 33 moves to the non-stopping position, there will be no problem when the discharged recording sheets are picked up.

It is preferable that the pushing force, for example, of the actuator 43 to move the sheet receiving member 12 to the normal position may be set larger than the pushing forces, for example, of the spring 42 and the coil spring 44 that push the sheet receiving member 12 in the direction toward the elevated position, and that the pushing forces of the spring 42 and the coil spring 44 are set to a magnitude such that allows the sheet receiving member 12 to move down further in the direction toward the normal position in response to the number of recording sheets discharged onto the sheet receiving surface 12P. When configured in this manner, the sheet receiving member 12 moves down in response to the number of recording sheets discharged onto the sheet receiving surface 12P. The uppermost portion of the recording sheets is thus always positioned at the constant level, which facilitates the picking up of the recording sheets.

When the spring 42, the coil spring 44, the actuator 43, and so forth are used, a transmission mechanism to transmit the driving force from the driving source of the image forming apparatus 10 to the supporting point 14 of the sheet receiving surface member 12 can be omitted, which makes the structure simpler.

Figure 13:
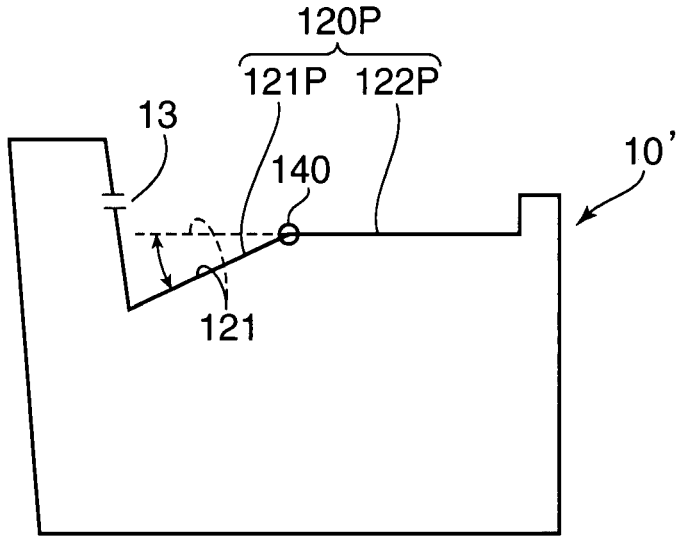
Figure 14:
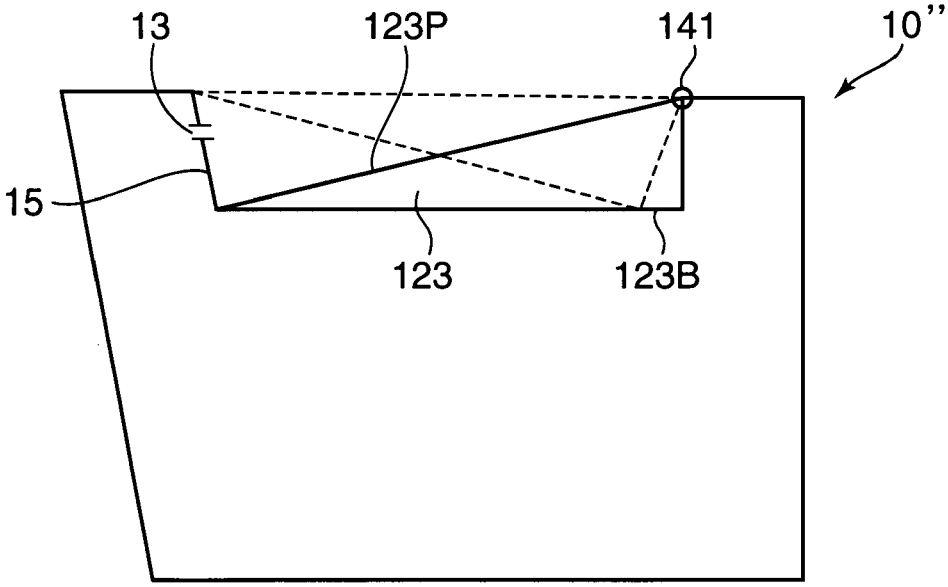

Other embodiments of the invention are shown in FIG. 13 and FIG. 14 by way of example. An image forming apparatus 10' shown in FIG. 13 shows an example where a sheet receiving surface 120P includes an inclined surface 121P that inclines downward toward the sheet discharge port 13 and a flat portion 122P positioned at a remote end from the sheet discharge port 13. Of the sheet receiving member 121, the portion that forms the inclined surface 121P alone swings in the top-bottom direction about the supporting point 140 set as the turning supporting point. In this embodiment, the sheet receiving member 121 does not close the sheet discharge port 13 even when it is in a state where it has moved up to the elevated position. As has been described, different from the embodiments above, it may be configured in such a manner that the sheet receiving member is swung in part or the sheet discharge port 13 is not closed.

An image forming apparatus 10" shown in FIG. 14 shows an example where a sheet receiving member 123 of a triangular shape when viewed in a side surface is adopted. The sheet receiving member 123 swings in the top-bottom direction about the supporting point 141 set as the turning supporting point, and an entire sheet receiving surface 123P inclines downward in a direction of the sheet discharge port 13 at the normal position. According to this image forming apparatus 10", the sheet receiving member 123 can be more readily supported using the rear end 123B of the sheet receiving member 123, which enables the sheet receiving member 123 to keep the posture at the elevated position in a stable manner.

In the image forming apparatus as described above, the sheet discharge portion 19 is provided on the top surface of the apparatus main body, and even when the sheet receiving surface 12P sinks on the sheet discharge port 13 side, the portion thus sunken can be readily cleaned. It is thus possible to provide an image forming apparatus that will not make recording sheets dirty with dust.

The specific embodiments described above include inventions including the following configurations.

An image forming apparatus according to one aspect of the invention includes: an apparatus main body that performs image forming processing to a recording sheet; a sheet receiving member provided on a top surface of the apparatus main body and provided with a sheet receiving surface; a sheet discharge port through which a recording sheet bearing thereon a formed image is discharged toward the sheet receiving surface; and a swinging mechanism that allows the sheet receiving member to swing, wherein the swinging mechanism allows the sheet receiving member to swing for the sheet receiving surface to change a posture between a first state where the sheet receiving surface sinks on the sheet discharge port side and a second state where the sheet receiving surface on the sheet discharge port side is closer to horizontal than in the first state.

By configuring the sheet receiving member so as to be allowed to swing as described above, it is possible to move the sheet receiving member to bring the sheet receiving surface in the second state where it is close to horizontal as the need arises to facilitate the cleaning of the dust on the sheet receiving surface.

In this case, it is preferable that the sheet receiving member receives a recording sheet discharged from the sheet discharge port when the sheet receiving surface is in the first state and closes the sheet discharge port when the sheet receiving surface is in the second state.

According to this configuration, by allowing the sheet receiving surface to be in the second state while the image forming apparatus is not in use and to be in the first state while in use, it is possible to clean the dust on the sheet receiving surface with ease when the image forming apparatus is not in use. When the image forming apparatus is used, by shifting the sheet receiving surface to the first state, it can be used as the sheet discharge portion on which recording sheets can be discharged in a stable manner as before.

In the configuration described above, it is preferable that the sheet receiving member makes the top surface of the apparatus main body substantially flat when the sheet receiving surface is in the second state. According to this configuration, by shifting the sheet receiving surface to the second state, the top surface of the image forming apparatus can be flat and an object can be placed thereon.

In the configuration described above, it is preferable to further include a stopping member that stops an end portion of the sheet receiving member when the sheet receiving surface is in the second state. When configured in this manner, it is possible to hold the sheet receiving surface in the second state in a stable manner.

In the configuration described above, it is preferable to further include a covering member that covers a clearance formed between an end portion of the sheet receiving member and a side wall in which the sheet discharge port is made when the sheet receiving surface is in the second state. This configuration makes it possible to fill the clearance.

In the configuration described above, it is preferable to further include a covering member that covers a clearance formed between an end portion of the sheet receiving member and a side wall in which the sheet discharge port is made when the sheet receiving surface is in the second state, and that the covering member is provided with a stopping member that stops the end portion of the sheet receiving member when the sheet receiving surface is in the second state.

According to this configuration, even when a clearance is formed between the sheet receiving member and the side wall having therein the sheet discharge port due to swings of the sheet receiving member, not only is it possible to close the clearance in preventing dust from going inside the image forming apparatus, but it is also possible to prevent the sheet receiving surface from moving down.

In this case, it is preferable to further include a moving mechanism that moves the covering member between a stopping position at which the sheet receiving member is stopped and a non-stopping position at which stopping of the covering member is released.

According to this configuration, the covering member is allowed to move freely between the position to stop the sheet receiving member and the non-stopping position while the image forming apparatus is in use.

In this case, it is preferable that the moving mechanism includes a first driving force transmission mechanism that confers a driving force to the covering member to move by sliding in two directions between the stopping position and the non-stopping position of the sheet receiving member.

Alternatively, it is preferable that the moving mechanism includes a first pushing member that pushes the covering member in a direction toward the stopping position and a first driving member that moves the covering member in a direction toward the non-stopping position against a pushing force of the first pushing member.

According to these configurations, the covering member can be moved with a simple configuration.

In the configuration described above, it is preferable to further include a driving source that generates a driving force, and a supporting point about which the sheet receiving member swings, wherein the swinging mechanism includes a swinging gear provided to the supporting point and a second driving force transmission mechanism that transmits the driving force from the driving source to the swinging gear.

Alternatively, in the configuration described above, it is preferable that the swinging mechanism includes a second pushing member that pushes the sheet receiving member in a direction toward a position to shift the sheet receiving surface to the second state and a second driving member that moves the sheet receiving member in a direction toward a position to shift the sheet receiving surface to the first state against a pushing force of the second pushing member.

According to these configurations, it is possible to swing the sheet receiving member with a simple configuration.

In this case, it is preferable that the driving force of the second driving member is larger than the pushing force of the second pushing member and the pushing force is of a magnitude such that allows the sheet receiving member to move down in the direction to shift the sheet receiving surface to the first state in response to the number of recording sheets discharged onto the sheet receiving surface.

According to this configuration, because the sheet receiving member moves down in response to the number of recording sheets discharged thereon and the uppermost portion of the recording sheets is kept at a constant level, it becomes easier to pick up the recording sheets.

In the configuration described above, it is preferable to further include a first power supply switch to be operated when the covering member has moved to the non-stopping position from the stopping position of the sheet receiving member.

According to this configuration, the turning-on of the power to the image forming apparatus is not allowed unless the covering member is moved, which can in turn prevent a recording sheet from being discharged while the sheet discharge port is closed. In addition, because a portion above the sheet discharge port that interferes with the picking up of the recording sheets is eliminated or becomes quite small as the covering member moves to the non-stopping position, there will be no problem when the discharged recording sheets are picked up.

In the configuration described above, it is preferable to configure in such a manner so as to further include a second power supply switch to be operated when the sheet receiving member has moved in a direction to shift the sheet receiving surface to the first state from the second state, to further include a third power supply switch to be operated when the sheet receiving member has moved in a direction to shift the sheet receiving surface to the first state from the second state against the pushing force of the second pushing member.

It is preferable to further provide a supporting point about which the sheet receiving member swings and a fourth power supply switch that is provided in close to the supporting point and is to be operated when the sheet receiving member has swung about the supporting point by a specific angle.

According to these configurations, it is possible to bring the turning-on of the power to the image forming apparatus in association with the movements of the sheet receiving member, which can in turn prevent image formation from being performed while the sheet receiving member closes the sheet discharge port.

In the configuration described above, the part of the sheet receiving member that is closer to the sheet discharge port may be preferably operable to swing.

According to the image forming apparatus of the invention having the configurations described above, because the sheet receiving member is formed so as to be allowed to swing for the sheet receiving surface to shift between the first state and the second state, the sheet receiving surface can be readily cleaned even when the sheet receiving surface sinks on the sheet discharge port. In addition, by moving the sheet receiving member to the normal position, it can be used as the sheet discharge portion on which recording sheets can be discharged in a stable manner as before. Moreover, by shifting the sheet receiving surface to the second state, the top surface of the image forming apparatus can be made substantially flat, so that an object can be placed thereon. It is thus possible to provide a more convenient image forming apparatus.

This application is based on patent application No. 2006-074309 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

an apparatus main body that performs image forming processing to a recording sheet;

a sheet discharge port through which a recording sheet bearing thereon a formed image is discharged;

a sheet receiving member provided on a top surface of the apparatus main body and provided with a sheet receiving surface for receiving the sheet discharged from the sheet discharge port, the sheet receiving member having an upstream end in proximity to the sheet discharge port and a downstream end remote from the sheet discharge port;

a supporting point provided at the downstream end of the sheet receiving member and about which the sheet receiving member is swingably supported; and a swinging mechanism that allows the sheet receiving member to swing about the supporting point, wherein the swinging mechanism allows the sheet receiving member to swing about the supporting point between a first state where a portion of the sheet receiving surface at the upstream end of the sheet receiving member sinks below the top surface of the apparatus main body and a second state where the upstream and downstream ends of the sheet receiving member are substantially horizontal.

2. The image forming apparatus according to claim 1, wherein the upstream end of the sheet receiving member is below the sheet discharge port when the sheet receiving member is in the first state and wherein the upstream end of the sheet receiving member is above the sheet discharge port when the sheet receiving member is in the second state.

3. The image forming apparatus according to claim 1, further comprising:

a covering member that covers a clearance formed between the upstream end of the sheet receiving member and a sidewall in which the sheet discharge port is formed when the sheet receiving member is in the second state, the covering member having a stop that stops the upstream end of the sheet receiving member when the sheet receiving member is in the second state; and a moving mechanism that moves the covering member between a stopping position at which the sheet receiving member is stopped and a non-stopping position at which the stopping of the covering member is released.

4. The image forming apparatus according to claim 3, wherein:

the moving mechanism includes a first driving force transmission mechanism that confers a driving force to the covering member to move by sliding in two directions between the stopping position and the non-stopping position of the sheet receiving member.

5. The image forming apparatus according to Claim 3, wherein:

the moving mechanism includes a pushing member that pushes the covering member in a direction toward the stopping position and a driving member that moves the covering member in a direction toward the non-stopping position against a pushing force of the pushing member.

6. The image forming apparatus according to claim 3, further comprising:

a power supply switch to be operated when the covering member has moved to the non-stopping position from the stopping position of the sheet receiving member.

7. The image forming apparatus according to claim 1, wherein:

the sheet receiving member receives a recording sheet discharged from the sheet discharge port when the sheet receiving surface is in the first state, and closes the sheet discharge port when the sheet receiving surface is in the second state.

8. The image forming apparatus according to claim 1, wherein:

the sheet receiving member makes the top surface of the apparatus main body substantially horizontal when the sheet receiving surface is in the second state.

9. The image forming apparatus according to claim 1, further comprising:

a stopping member that stops an end portion of the sheet receiving member when the sheet receiving surface is in the second state.

10. The image forming apparatus according to claim 1, further comprising:

a covering member that covers a clearance formed between an end portion of the sheet receiving member and a side wall in which the sheet discharge port is made when the sheet receiving surface is in the second state.

11. The image forming apparatus according to claim 1, further comprising:

a covering member that covers a clearance formed between an end portion of the sheet receiving member and a side wall in which the sheet discharge port is made when the sheet receiving surface is in the second state, wherein the covering member is provided with a stopping member that stops the end portion of the sheet receiving member when the sheet receiving surface is in the second state.

12. The image forming apparatus according to claim 1, further comprising:

a driving source that generates a driving force; and wherein the swinging mechanism includes a swinging gear provided to the supporting point and a driving force transmission mechanism that transmits the driving force from the driving source to the swinging gear.

13. The image forming apparatus according to claim 1, wherein:

the swinging mechanism includes a pushing member that pushes the sheet receiving member in a direction toward a position to shift the sheet receiving surface to the second state and a driving member that moves the sheet receiving member in a direction toward a position to shift the sheet receiving surface to the first state against a pushing force of the pushing member.

14. The image forming apparatus according to claim 13, wherein:

a driving force of the driving member is larger than the pushing force of the pushing member and the pushing force is of a magnitude such that allows the sheet receiving member to move down in the direction to shift the sheet receiving surface to the first state in response to the number of recording sheets discharged onto the sheet receiving surface.

15. The image forming apparatus according to claim 13, further comprising:

a power supply switch to be operated when the sheet receiving member has moved in a direction to shift the sheet receiving surface to the first state from the second state against the pushing force of the pushing member.

16. The image forming apparatus according to claim 1, further comprising:

a power supply switch to be operated when the sheet receiving member has moved in a direction to shift the sheet receiving surface to the first state from the second state.

17. The image forming apparatus according to claim 1, further comprising:

a supporting point about which the sheet receiving member swings; and a power supply switch that is provided in close to the supporting point and is to be operated when the sheet receiving member has swung about the supporting point by a specific angle.

18. The image forming apparatus according to claim 1, wherein:

the part of the sheet receiving member that is closer to the sheet discharge port is operable to swing.

* * * * *